US008555900B2

(12) United States Patent
Nicoll et al.

(10) Patent No.: US 8,555,900 B2
(45) Date of Patent: Oct. 15, 2013

(54) RAZORS AND KITS FOR APPLYING SHAVING AIDS

(71) Applicant: The Gillette Company, Boston, MA (US)

(72) Inventors: Roy Nicoll, Wokingham (GB); Matthias Gester, Farnborough (GB)

(73) Assignee: The Gillette Company, Boston, MA (US)

( * ) Notice: Subject to any disclaimer, the term of this patent is extended or adjusted under 35 U.S.C. 154(b) by 0 days.

(21) Appl. No.: 13/833,820

(22) Filed: Mar. 15, 2013

(65) Prior Publication Data

US 2013/0199046 A1 Aug. 8, 2013

Related U.S. Application Data

(62) Division of application No. 12/622,540, filed on Nov. 20, 2009, now abandoned.

(51) Int. Cl.

| | |
|---|---|
| ***A45D 27/16*** | (2006.01) |
| ***A45D 27/18*** | (2006.01) |
| ***A45D 27/22*** | (2006.01) |
| ***A45C 11/26*** | (2006.01) |
| ***B26B 19/44*** | (2006.01) |
| ***B65D 73/00*** | (2006.01) |
| ***B26B 21/40*** | (2006.01) |

(52) U.S. Cl.
USPC ..... 132/290; 132/289; 30/41; 30/541; 206/352; 206/471; 206/349

(58) Field of Classification Search
USPC ..... 132/290, 215, 286, 289, 294, 297, 333; 206/208, 228, 229, 352, 354, 557, 562, 206/563, 564, 823, 581, 471, 349; 30/32, 30/34.2, 34.05, 40.2, 77, 535, 541, 41, 30/41.5; 222/192, 129, 321.1; 229/406, 229/407; 428/41.7, 41.8, 42.3; 220/507, 220/523, 524, 553
See application file for complete search history.

(56) References Cited

U.S. PATENT DOCUMENTS

| | | | |
|---|---|---|---|
| 1,643,171 | A | 9/1927 | Orme |
| 2,200,046 | A | 5/1940 | Straus |
| 4,412,618 | A | 11/1983 | La Conte |
| 4,656,068 | A | 4/1987 | Raines |
| D320,342 | S | 10/1991 | Gray |
| 5,095,924 | A | 3/1992 | Stanfield |
| 5,319,852 | A | 6/1994 | Metzger |
| 5,407,066 | A | 4/1995 | Grange |
| 5,782,346 | A | 7/1998 | Gray et al. |
| 6,006,760 | A | 12/1999 | Benzinger |
| 6,012,463 | A | 1/2000 | Mitchell, Jr. |
| 6,014,975 | A | 1/2000 | Benzinger |
| 6,413,599 | B1 | 7/2002 | Petricca et al. |

(Continued)

*Primary Examiner* — Vanitha Elgart
(74) *Attorney, Agent, or Firm* — John M. Lipchitz; Kevin C. Johnson; Steven W. Miller

(57) ABSTRACT

A safety razor is provided having a handle, a cartridge mounted to the handle and a pair of primary guards joined to the cartridge, each of the primary guards having a plurality of fins that define a plurality of fin slots. The safety razor also includes one or more primary shaving blades mounted to the cartridge and positioned adjacent the pair of primary guards. A shaving aid retention guard is positioned between the pair of primary guards. The shaving aid retention guard has a plurality of walls defining a plurality of guard slots, wherein a width of the guard slots is greater than the width of the fin slots.

13 Claims, 11 Drawing Sheets

(56) References Cited

U.S. PATENT DOCUMENTS

| | | | |
|---|---|---|---|
| 6,499,595 | B1 | 12/2002 | Petricca |
| 6,541,090 | B2 | 4/2003 | Grosskopf et al. |
| 6,550,141 | B1 | 4/2003 | Rivers et al. |
| 6,598,609 | B2 | 7/2003 | Gibbs |
| 6,780,825 | B2 | 8/2004 | Piterski et al. |
| 6,941,659 | B2 | 9/2005 | Gilder |
| 6,986,207 | B2 | 1/2006 | Selek |
| 7,159,324 | B2 | 1/2007 | Worrick, III |
| 7,204,256 | B2 | 4/2007 | Abergel |
| 7,422,782 | B2 | 9/2008 | Haedt et al. |
| 7,487,593 | B2 | 2/2009 | Dansreau et al. |
| 7,578,391 | B2 | 8/2009 | Nakamura |
| 7,631,757 | B2 | 12/2009 | Petricca |
| 2002/0157683 | A1 | 10/2002 | Gibbs |
| 2004/0188470 | A1 | 9/2004 | Hill |
| 2005/0218033 | A1 | 10/2005 | Curtis |
| 2006/0225285 | A1 | 10/2006 | Slavtcheff et al. |
| 2008/0034590 | A1 | 2/2008 | Prudden et al. |
| 2009/0178282 | A1 | 7/2009 | Guay et al. |
| 2009/0321292 | A1 | 12/2009 | Prudden et al. |

RAZORS AND KITS FOR APPLYING SHAVING AIDS

FIELD OF THE INVENTION

The present invention relates to methods and systems for shaving hair. More particularly, the present invention relates to shaving systems, having shaving trays for storing a shaving razor and holding a shaving aid, shaving razors having guard members for retaining and applying shaving aid to the skin, and methods of using such shaving razors and systems.

BACKGROUND OF THE INVENTION

Typically, men and women shave their bodies by applying a layer of shaving aid such as a gel, cream, soap, or lotion with their hands to the area of skin to be shaved. The user then shaves their skin with a wet shaving razor. The wet shaving razor is periodically rinsed in water to remove the cut hairs that become trapped in the wet shaving razor. This method of shaving requires the user to purchase a can or tube of shaving aid and a wet shaving razor which may be a disposable shaving razor or a shaving razor system having a disposable cartridge. The tube or can of shaving provides enough shaving aid for numerous shaves and outlasts the life of several disposable shaving razor and/or the disposable cartridge.

The above mentioned method of shaving has several drawbacks. First, this method of shaving requires a consumer to purchase and apply more shaving aid than is necessary. For example, some consumers will need to shave when they are traveling on business or vacation. Currently, strict airport policies regarding carry on articles for sharp articles, such as blades as well as limitations on the amount of carry on liquid toiletries allowed has created a severe inconvenience for the frequent as well as the occasional traveler. Some travelers prefer purchasing new shaving aids and shaving razors when they arrive at their destination rather than dealing with the hassle of carrying such items onto an airplane. Although relatively inexpensive disposable razors are available, consumers must also purchase a can or tube of shaving aid, which can be expensive, especially if the shaving aid is only needed for a couple of shaves. The can or tube of shaving aid contains an overabundance of shaving aid, which is typically thrown away with the disposable razor before the traveler returns home. If the consumer prefers to carry on their shaving supplies, the shaving aid container(s) add extra weight and volume that can be used for other toiletries. The typical traveler does not need an entire container of lotion, unless they are staying away from home for an extended period of time.

When the consumer shaves an excess of shaving aid is typically applied to the hand and massaged onto the skin. This process is messy and produces an extensive amount of wasted shaving aid which requires the consumer to wash off their hands prior to taking hold of their razor. Shaving aid is thus wasted on every shave, which is not very economical. The process of rinsing also creates issues if there is not readily available running water, or if water is trying to be conserved. For example, the availability of running water may be scarce for consumers who hike or camp in the wilderness away from modem conveniences. Consumers in certain regions of the globe, such as emerging markets may also have limited access to any water. In certain instances no water is readily available. For example, consumers who are constantly in a rush often find the need to shave in atypical locations such as in a car or on public transportation. The process of applying the shaving aid is also messy, which does not lend itself to consumers who are in a rush and shave on the go. For these reasons, some consumers tend to use an electric shaver or put off shaving altogether, even though the look and feel of a close smooth shave from a wet shaver is ideally preferred.

SUMMARY OF THE INVENTION

In one aspect, the invention features, in general, a safety razor having a handle, a cartridge mounted to the handle and a pair of primary guards joined to the cartridge, each of the primary guards having a plurality of fins that define a plurality of fin slots. The safety razor also includes one or more primary shaving blades mounted to the cartridge and positioned adjacent the pair of primary guards. A shaving aid retention guard is positioned between the pair of primary guards. The shaving aid retention guard has a plurality of walls defining a plurality of guard slots, wherein a width of the guard slots is greater than the width of the fin slots.

In another aspect, the invention features, in general, a safety razor having a handle, a cartridge with a proximal end portion and a distal end portion mounted to the handle. One or more shaving blades are mounted to the cartridge and a guard is joined to the distal end portion of the cartridge. The guard has an elongated slot being defined by a proximal wall, a distal wall and a pair of side walls, wherein the elongated slot has a width to length ratio of about 1:10 to about 1:25.

In yet another aspect, the invention features, in general a shaving system having a safety shaving razor, a shaving tray and a container of shaving aid. The safety shaving razor has an elongated handle, a cartridge mounted to the elongated handle, and a shaving aid retention guard joined to the cartridge. The shaving tray has a first portion dimensioned to receive the safety shaving razor during storage and a second portion defining a receptacle. The container of shaving aid positioned within the receptacle.

In yet another aspect, the invention features, in general a method of shaving comprising the steps of placing a shaving razor cartridge having a guard in a container of shaving aid, retaining the shaving aid with the guard, placing the shaving razor cartridge against an area of skin to be shaved, applying the shaving aid to the area of skin with the shaving razor cartridge by compressing the guard and shaving the area of skin by moving the shaving razor cartridge across the area of skin.

DETAILED DESCRIPTION OF THE INVENTION

Figure 1:
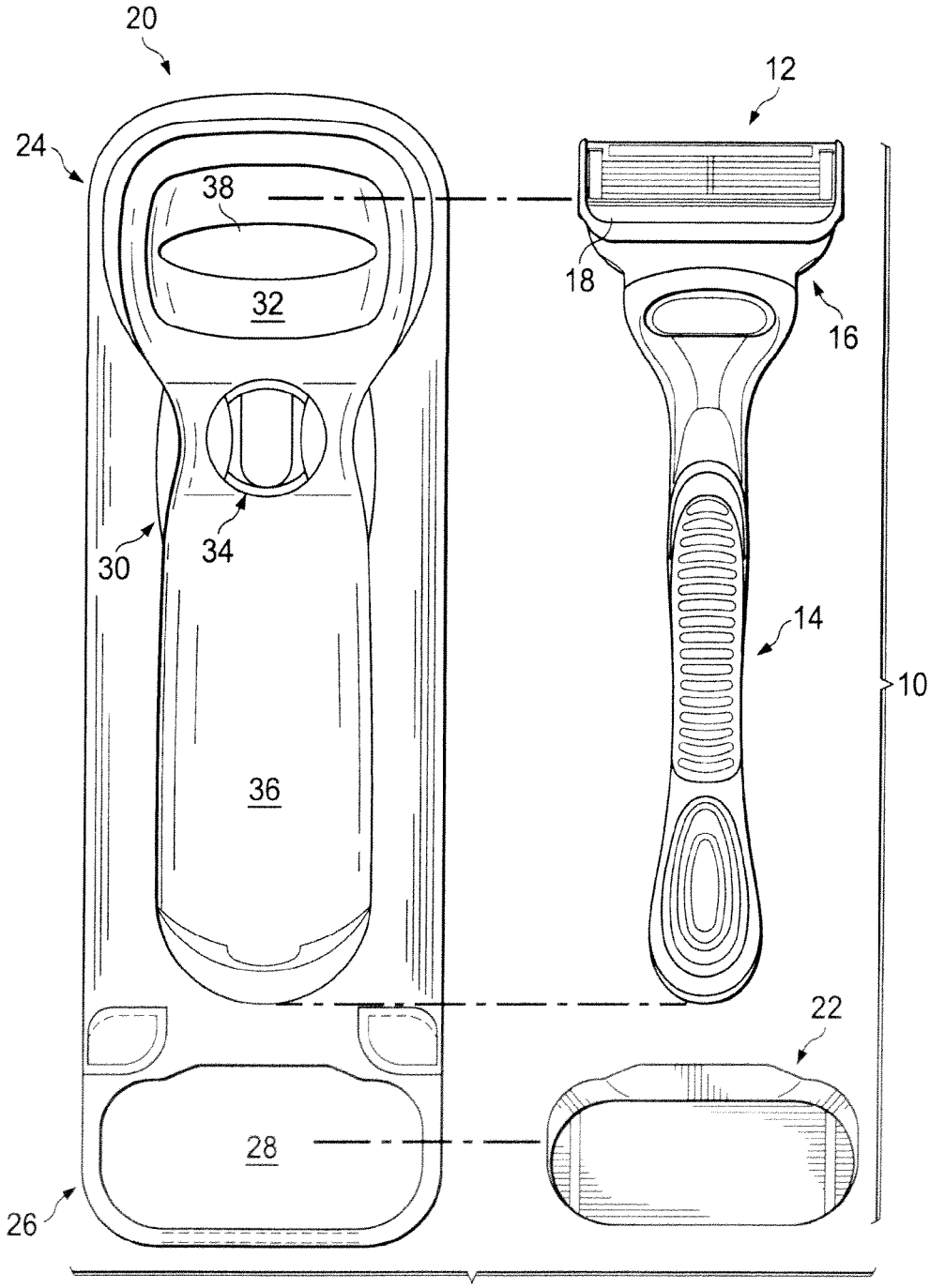
FIG. 1 is a top plan view of one possible embodiment of a wet shaving system.

Referring to FIG. 1, the present disclosure is generally related to providing a shaving system 10 that includes a wet shaving razor 12 having a handle 14 and a cartridge 16 mounted to the handle. In certain embodiments, the cartridge 16 may be detachably and/or pivotably mounted to the handle 14. The cartridge 16 may be removed from the handle 14 and replaced with a new cartridge 16 as needed by a user, thus reusing the handle 14. In other embodiments, the cartridge 16 may be fixedly mounted to the handle 14 and the consumer may dispose of the wet shaving razor 12 and replace it with a new wet shaving razor 12 as desired. As will be described in greater detail below, the cartridge 16 may include a shaving aid retention guard 18 for applying shaving aid to a skin surface during shaving. The shaving system 10 may include a shaving tray 20 for holding the wet shaving razor 12 and a disposable container of shaving aid 22.

The shaving tray 20 may have a proximal end portion 24 and a distal end portion 26. The distal end portion 24 may define a receptacle 28 that is dimensioned to receive the disposable container of shaving aid 22. Alternatively, the receptacle 28 may be filled with shaving aid. A wet shaving razor storage portion 30 may be positioned between the proximal end portion 24 and the distal end portion 26. The wet shaving razor storage portion 30 may have a recessed area 32, a handle retaining member 34 and a generally open area 36. The recessed area 32 may be dimensioned to receive the cartridge 16 and the generally open area 36 may be dimensioned to receive the handle 14 of the wet shaving razor 12. The recessed area 32 may define a drainage aperture 38 that extends through the shaving tray 20, which may aid in drying the cartridge 16 after shaving. The handle retaining member 34 may secure the handle 14 to the shaving tray 20 and may be positioned between the recessed area 32 and the generally open area 36. The shaving tray 20, the shaving razor 12 and the container of shaving aid 22 may be packaged together as a kit. The container of shaving aid 22 may be purchased separately and replaced as needed. The shaving razor 12 may be disposable and may be thrown away with the tray 20 and the container of shaving aid 22 after a certain number of shaves. In certain embodiments, the shaving razor 12 and the container of shaving aid 22 may be packaged as a kit without the shaving tray 20.

Figure 2:
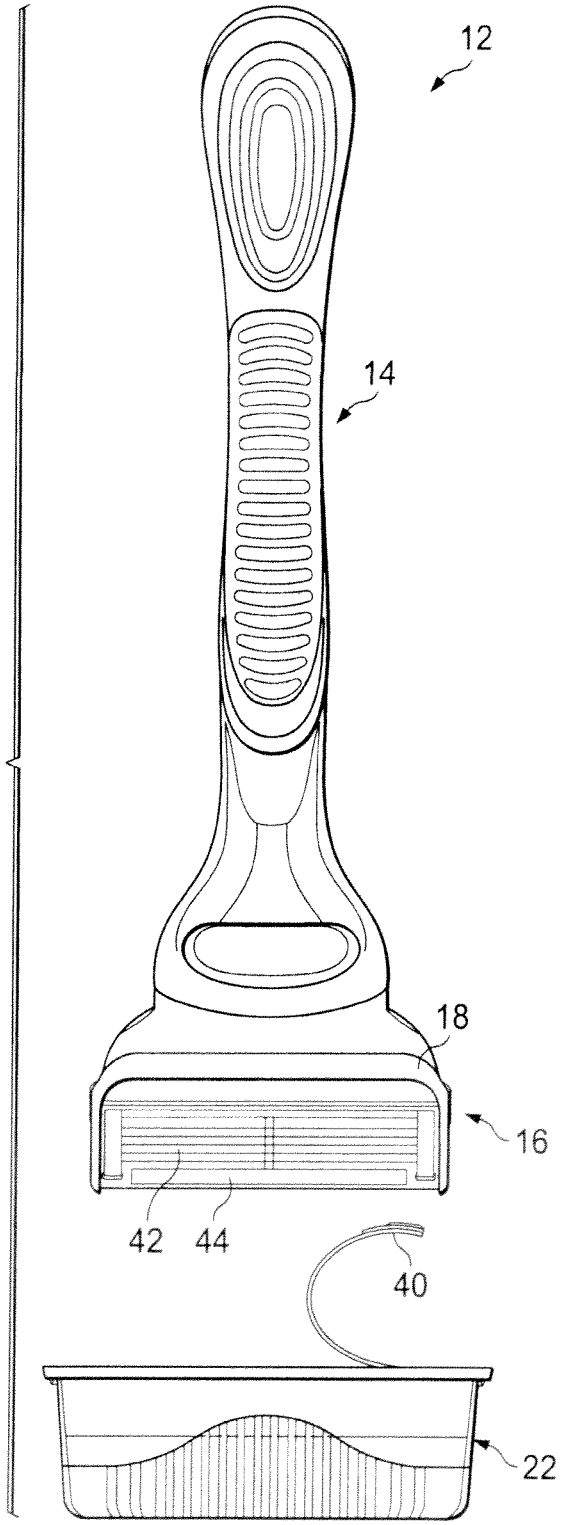
FIG. 2 is a front view of one possible embodiment of a wet shaving razor and a container of shaving aid which may be incorporated into the shaving system of FIG. 1.

Referring to FIG. 2, the wet shaving razor 12 is shown being inserted into the container of shaving aid 22, which may be positioned within the receptacle 28 of the shaving tray 20 (not shown). The wet shaving razor 12 may have one or more blades 42 positioned between a cap 44 at a rear portion of the cartridge 16 and the shaving aid retention guard 18 at a front portion of the cartridge 16. In certain embodiments, the shaving aid retention guard 18 may be used in place of the cap 44, thus the cartridge 16 may also include a plurality of shaving aid retention guards 18 or may have the shaving aid retention guard 18 in the cap 44 position. The container of shaving aid 22 may have a lid 40. The lid 40 may be a peelable lid that is removed from the container of shaving aid 22 or the lid 40 may be resealable onto the container of shaving aid 22 utilizing a snap fit design. The container of shaving aid 22 may be dimensioned to receive the cartridge 16 of the wet shaving razor 12. The container of shaving aid 22 may be slightly larger than the size of the cartridge 16 and may contain enough shaving aid for about 1 or 2 to about 4 or 5 shaves. The container of shaving aid 22 may have a generally rectangular shape with a length that generally corresponds to a length of the cartridge 16. In certain embodiments, the length of the container of shaving aid may be about 25 mm, 35 mm or 45 mm to about 55 mm, 65 mm or 75 mm. The container of shaving aid 22 may have a height that corresponds to a width of the cartridge 16 which may prevent an excess of shaving aid from getting on the handle 14. In certain embodiments, the height of the container of shaving aid may be about 10 mm, 12 mm or 14 mm to about 20 mm, 30 mm or 40 mm. The container of shaving aid 22 may also have a width that generally corresponds to the width of the cartridge 16, as previously described.

A user may insert the cartridge 16 into the container of shaving aid 22, such that shaving aid retention guard 18 contacts and retains a certain amount of shaving aid. The cartridge 16 may then be placed against an area of skin to be shaved. As the cartridge 16 passes along the surface of the skin the shaving aid retention guard 18 may apply the shaving aid just prior to the one or more blades 42 shaves the area. The shaving aid may be applied to the skin simultaneously as the one or more blades 42 shaves the skin. Alternatively, the user may place only the shaving aid retention guard 18 against the area of skin to be shaved. The shaving aid retention guard 18 may apply the shaving aid to the entire area to be shaved before the blades 42 contact the skin. The user may then contact the cartridge 16 and the one or more blades 42 against the surface of the skin and proceed to shave the area. The user may periodically rinse the cartridge 16 as needed. Hair trapped in the cartridge 16 may be rinsed by placing the cartridge 16 back into the container of shaving aid. The shaving aid may have a lower viscosity than typical shaving lotions and gels, which may aid in rinsing and cleaning the one or more blades 42. In certain embodiments, Nivea Cool Gel Shaving Balm (Philips Philishave HQ170 of HQ171) by Koninklijke Philips Electronics N.V may be used in the container of shaving aid 22 (or in a tube or sachet as will be described in greater detail below).

Figure 3A:
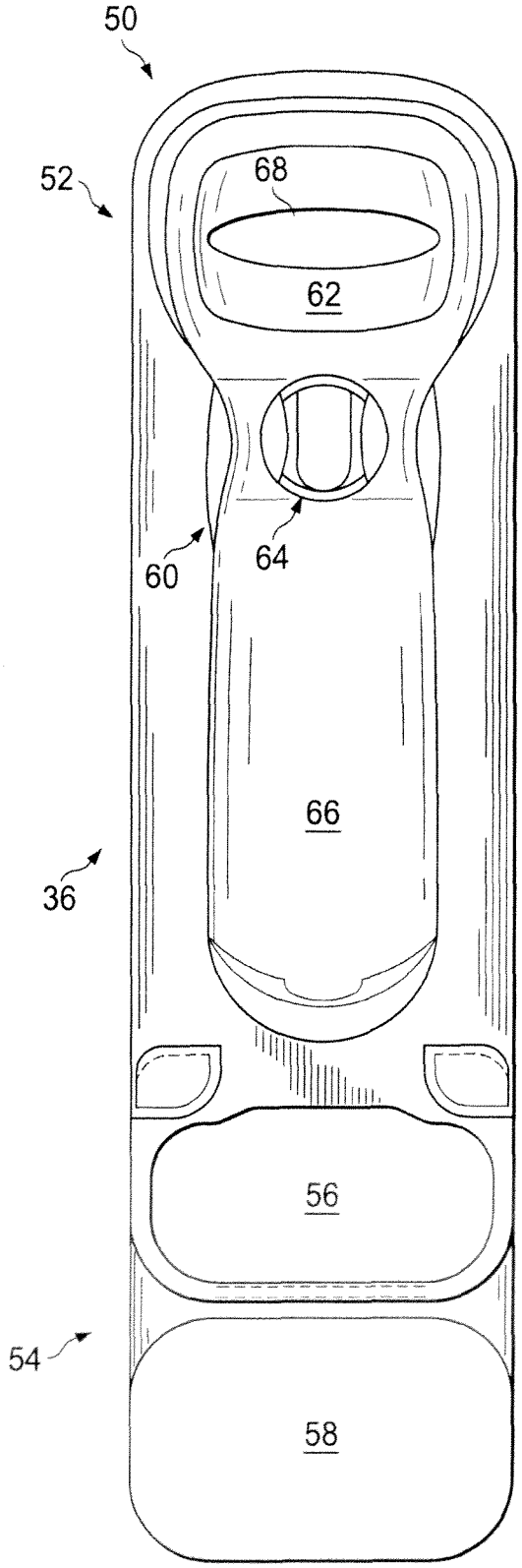
FIG. 3A is a top plan view of one possible embodiment of a shaving tray.

Referring to FIG. 3A, an alternative embodiment of a shaving tray 50 is shown. The shaving tray 50 may be similar to the shaving tray 20 as previously described and shown in FIG. 1. The shaving tray 50 may have a proximal end portion 52 and a distal end portion 54. The distal end portion 54 may define a first receptacle 56 that is dimensioned to receive the disposable container of shaving aid 22 (not shown). The distal end portion 54 may also define a second receptacle 58, which may be a rinsing basin. The second receptacle 58 may be filled with water or other rinsing solutions. The wet shaving razor 12 (not shown) may be a vibrating razor which may aid in rinsing the cartridge 16 (not shown) in the second receptacle 58. A wet shaving razor storage portion 60 may be positioned between the proximal end portion 52 and the distal end portion 54. The wet shaving razor storage portion 60 may have a recessed area 62, a handle retaining member 64 and a generally open area 66. The recessed area 62 may be dimensioned to receive the cartridge 16 (not shown) and the generally open area 66 may be dimensioned to receive the handle 14 of the wet shaving razor 12 (not shown). The recessed area 62 may define a drainage aperture 68 that extends through the shaving tray 50, which may aid in drying the cartridge 16 (not shown) after shaving. The handle retaining member 64 may secure the handle 14 (not shown) to the shaving tray 50 and may be positioned between the recessed area 62 and the generally open area 66.

The second receptacle 58 may have a generally rectangular shape with a length that generally corresponds to a length of the cartridge 16 (not shown). The second receptacle 58 may be the same size or larger than the container of shaving aid 22 (see FIG. 2). In certain embodiments, the length of second receptacle 58 may be about 35 mm, 45 mm or 55 mm to about 65 mm, 75 mm or 85 mm. The second receptacle 58 may also have a height that generally corresponds to a width of the cartridge 16 which may prevent an excess of water or rinsing solution from getting on the handle 14 (not shown). In certain embodiments, the height of rinsing basin 58 may be about 10 mm, 12 mm or 14 mm to about 20 mm, 30 mm or 40 mm.

Figure 3B:
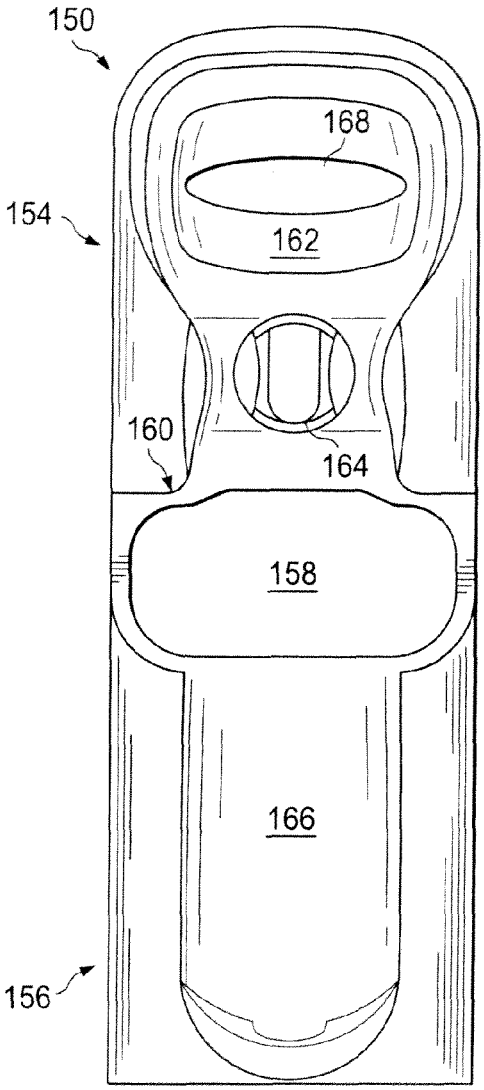
FIG. 3B is a top plan view of another possible embodiment of a shaving tray.

Referring to FIG. 3B, a top plan view of another possible embodiments of a shaving tray 150 is shown. The shaving tray 150 may have a proximal end portion 154 and a distal end portion 156. A wet shaving razor storage portion 160 may be positioned between the proximal end portion 154 and the distal end portion 156. The wet shaving razor storage portion 160 may define a receptacle 158 that is dimensioned to receive the disposable container of shaving aid 22 shown in FIGS. 1 and 2. Alternatively, the receptacle 158 may be filled with shaving aid. The wet shaving razor storage portion 160 may have a recessed portion 162, a handle retaining member 164 and a generally open area 166. The recessed portion 162 may be dimensioned to receive the cartridge 16 (not shown) and the generally open area 166 may be dimensioned to receive the handle 14 (not shown) of the wet shaving razor 12 (not shown). The recessed portion 162 may define a drainage aperture 168 that extends through the shaving tray 150, which may aid in drying the cartridge 16 (not shown) after shaving. The handle retaining member 164 may secure the handle 14 to the shaving tray 150 and may be positioned between the recessed portion 162 and the generally open area 166. The shaving tray 150 may be similar to the shaving tray 20 as previously described and shown in FIG. 1. The receptacle 158 of shaving tray 150, however, may be positioned within the razor storage portion 160 or within the generally open area 166. The position of the receptacle 158 away from the distal end portion 156, may allow for the container of shaving aid 22 to be held by the shaving tray 150 without having to increase the overall length of the shaving tray 150.

The shaving tray 150, the shaving razor 12 and the container of shaving aid 22 may be packaged together as a kit. The container of shaving aid 22 may be purchased separately and replaced in the receptacle 158 of the tray 150 as needed. The shaving razor 12 may be disposable and may be thrown away with the tray 150 and the container of shaving aid 22 after a certain number of shaves. In certain embodiments, the shaving razor 12 and the container of shaving aid 22 may be packaged as a kit without the shaving tray 150.

Figure 3C:
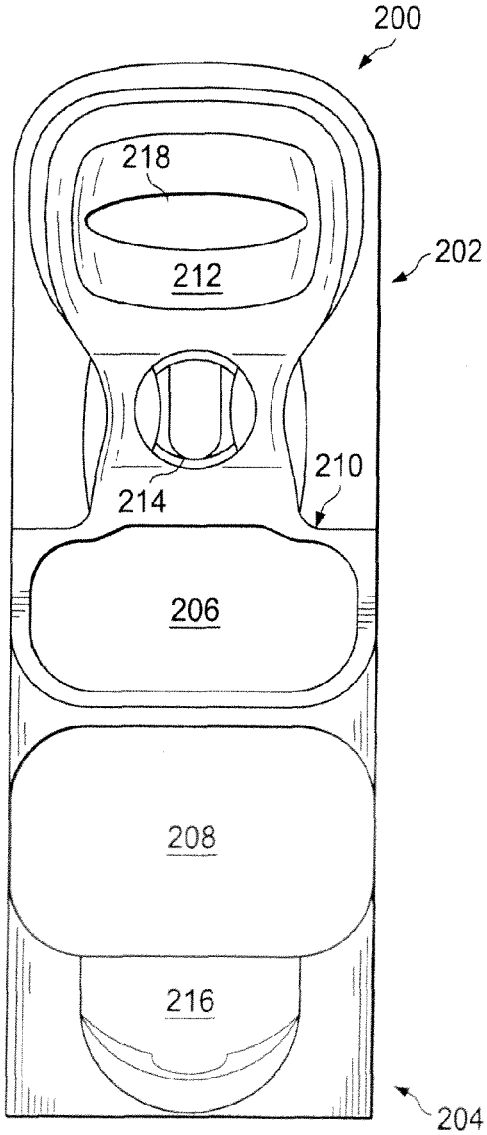
FIG. 3C is a top plan view of another possible embodiment of a shaving tray.

Referring to FIG. 3C, a top plan view of yet another possible embodiment of a shaving tray 200 is shown. The shaving tray 200 may be similar to the shaving tray 50 as previously described and shown in FIG. 3A. The shaving tray 200 may have a proximal end portion 202 and a distal end portion 204. A wet shaving razor storage portion 210 may be positioned between the proximal end portion 202 and the distal end portion 204. The wet shaving razor storage portion 210 may define a first receptacle 206 that is dimensioned to receive the disposable container of shaving aid 22 (not shown). The wet shaving razor storage portion 210 may also define a second receptacle 208, such as a rinsing basin 208 which may be filled with water or other rinsing solutions. The wet shaving razor 12 (not shown) may be a vibrating razor having a vibrating cartridge 16 which may aid in rinsing the cartridge 16 (not shown) in the second receptacle 208. The wet shaving razor storage portion 210 may have a recessed area 212, a handle retaining member 214 and a generally open area 216. The recessed area 212 may be dimensioned to receive the cartridge 16 (not shown) and the generally open area 216 may be dimensioned to receive the handle 14 (not shown) of the wet shaving razor 12 (not shown). The recessed area 212 may define a drainage aperture 218 that extends through the shaving tray 200, which may aid in drying the cartridge 16 (not shown) after shaving. The handle retaining member 214 may secure the handle 14 (not shown) to the shaving tray 200 and may be positioned between the recessed area 212 and the generally open area 216.

The second receptacle 208 may have a generally rectangular shape with a length that generally corresponds to a length of the cartridge 16 (not shown). The rinsing basin 208 may be the same size or larger than the container of shaving aid 22 (see FIG. 2). In certain embodiments, the length of rinsing basin 208 may be about 35 mm, 45 mm or 55 mm to about 65 mm, 75 mm or 85 mm. The second receptacle 208 may also have a height that generally corresponds to a width of the cartridge 16 which may prevent an excess of water or rinsing solution from getting on the handle 14 (not shown). In certain embodiments, the height of second receptacle 208 may be about 10 mm, 12 mm or 14 mm to about 20 mm, 30 mm or 40 mm. The shaving tray 200 may be similar to the shaving tray 50 as previously described and shown in FIG. 3A, however, the receptacle 206 and the rinsing basin 208 of shaving tray 200 may be positioned within the razor storage portion 210 or the generally open area 216. The position of the receptacle 206 and the rinsing basin 208 away from the distal end portion 204 may allow for the container of shaving aid 22 to be held by the shaving tray 200 without having to increase the overall length of the shaving tray 200.

Figure 3D:
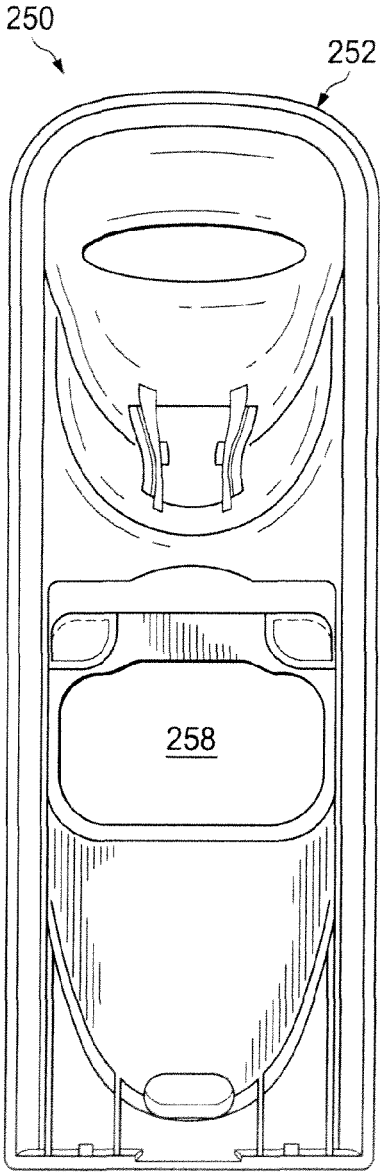
FIG. 3D is a bottom plan view of yet another possible embodiment of a shaving tray.
Figure 3E:
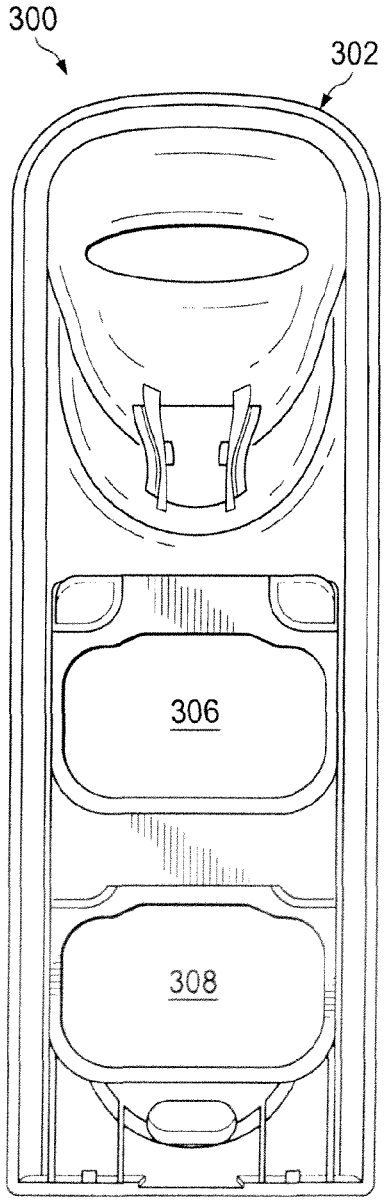
FIG. 3E is a bottom plan view of yet another possible embodiment of a shaving tray.

Referring to FIGS. 3D and 3E, alternative embodiments of shaving trays 3D and 3E are shown to illustrate that a shaving tray 250 and 300 may have a receptacle 258 and 306 (respectively) for the shaving aid 22 and/or a second receptacle 308 located on a bottom surface 252 and 302 of the respective shaving tray 250 and 300. Any of the embodiments described within this application may include one or more receptacles for the shaving aid container 22, one or more basins for rinsing solutions, or any combination thereof. The one or more receptacles and/or basins may be positioned on a top surface (as shown in FIGS. 1, 3A, 3B and 3C) or a bottom surface (as shown in FIGS. 3D, 3E) of a shaving tray, at a distal end portion (as shown in FIGS. 1 and 3A) of a shaving tray, at a proximal end portion of a shaving tray, within a shaving razor storage portion (as shown in FIGS. 3B and 3C) of a tray, or any combination thereof. The location of the receptacles 258, 306 and 308 on the bottom surface of the shaving tray 250 and 300 may decrease the overall length and side of the tray, making the shaving system more compact.

Figure 4A:
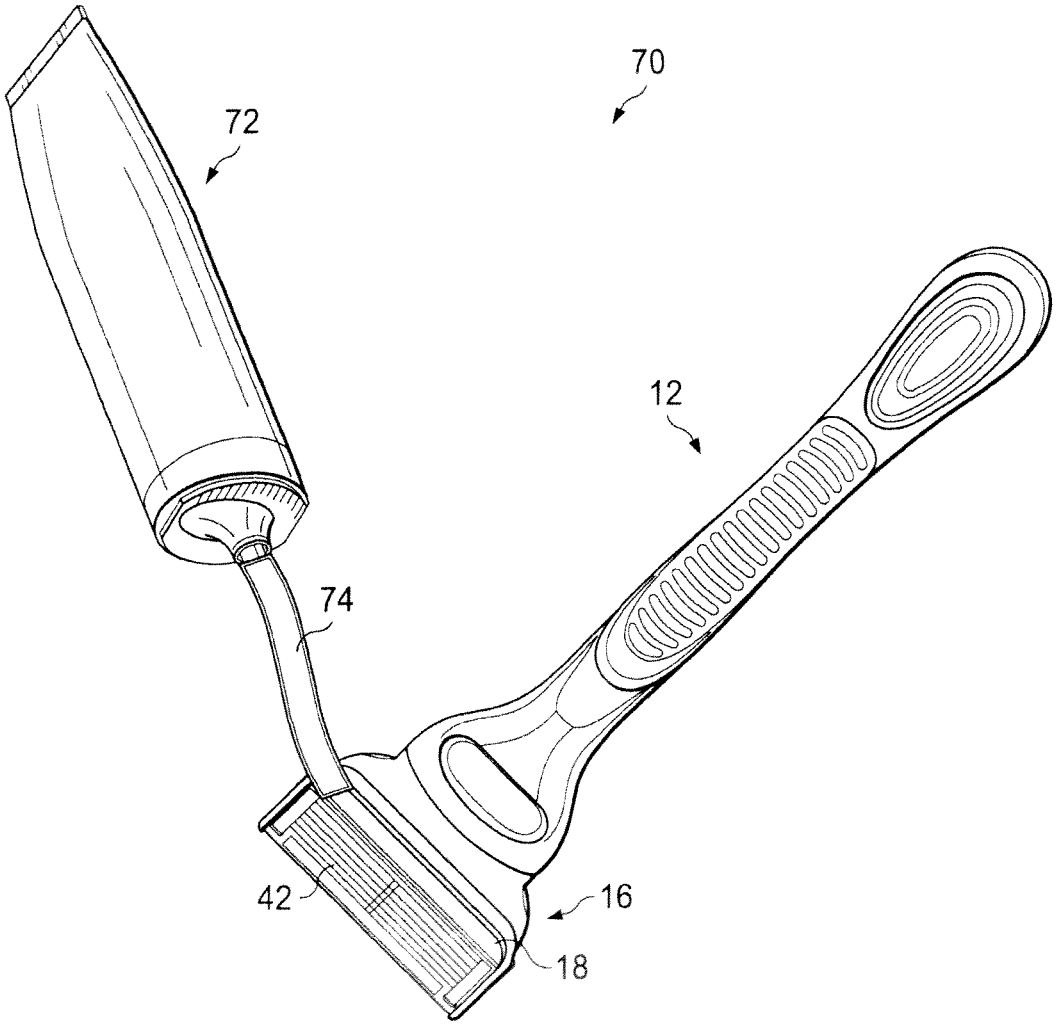
FIG. 4A is a perspective view of another possible embodiment of a wet shaving razor system.

Referring to FIG. 4A, an alternative embodiment of a shaving system 70 is illustrated which may include the wet shaving razor 12 and a flexible package of shaving aid 72, such as a tube. The shaving aid 74 may have a viscosity greater than that of the container of shaving aid 22 as previously described. The viscosity of the shaving aid 74 (or shaving aid in the container of shaving aid 22) may be similar to toothpaste or gel, such that a strip of the shaving aid 74 may be applied to and retained by the shaving aid retention guard 18. In certain embodiments, the shaving aid 74 may have a viscosity of about 2,000, 10,000 or 25,000 centipoise to about 50,000, 75,000 or 250,000 centipoise at room temperature (about 23 degrees Celsius). In other embodiments, the shaving aid 74 may have a viscosity of about 10, 50 or 100 centipoise to about 150, 250 or 500 centipoises at room temperature (about 23 degrees Celsius).

A user may release the shaving aid 74 from the flexible package of shaving aid 72 onto the shaving aid retention guard 18. The cartridge 16 may then be placed against an area of skin to be shaved. As the cartridge 16 passes along the surface of the skin, the shaving aid retention guard 18 may apply the shaving aid 74 just prior to the one or more blades 42 shaving the area. The shaving aid 74 may be applied to the skin simultaneously as one or more blades 42 shave the skin. Alternatively the user may first pass only the shaving aid retention guard 18 against the area of skin to be shaved. The shaving aid retention guard 18 may apply the shaving aid to the entire area to be shaved before the blades 42 contact the skin. The user may then contact the cartridge 16 and the one or more blades 42 against the surface of the skin and proceed to shave the area. The user may periodically rinse the cartridge 14 as needed. Either the flexible package of shaving aid 72 or the container of shaving aid 22 may be used with the shaving aid retention guard 18 of the wet shaving razor 12 or any of the embodiments described in this application.

Figure 4B:
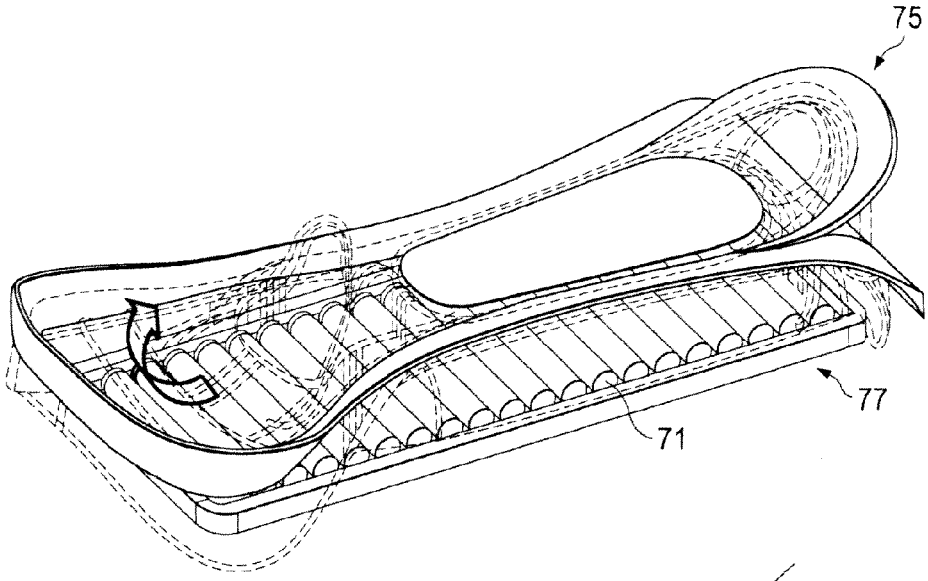
FIG. 4B is a perspective view of another possible embodiment of a shaving tray and a container of shaving aid.
Figure 4C:
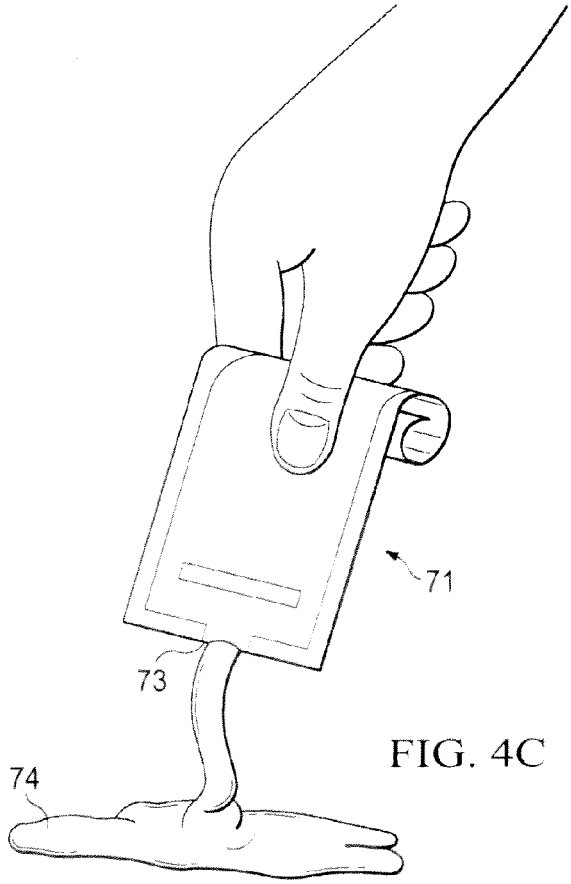
FIG. 4C is a perspective view of a container of shaving aid.

As shown in FIGS. 4B and 4C, the shaving system 70 (FIG. 4A) may also include a shaving razor tray 75 and one or more sachets 71 of shaving aid 74. The one or more sachets 71 may be used in place of the tube of shaving aid 72 shown in FIG. 4A. The shaving razor tray 75 may have a top surface with a wet shaving razor portion, which holds or stores the shaving razor 12 (not shown) when the shaving razor 12 (not shown) is not in use. The sachets 71 may be releasably joined together and mounted to a bottom surface of the shaving tray 75. The user may tear or remove one of the sachets 71 for each shave. The shaving tray 75 may include a removable cartridge 77 having the one or more sachets 71 interconnected to one another and mounted to the removable cartridge 77. The removable cartridge 77 may be detachably mounted to the bottom surface of the tray 75. The sachet(s) 71 may have a tear off or break away top 73, as shown in FIG. 4C for dispensing the shaving aid 74. The break away top 73 may be dimensioned to spread a narrow band of shaving aid 74 to a guard member (such as shaving aid retention guard 18 shown in FIG. 4A). Alternatively, the break away top 73 may be dimensioned to spread a broader band of shaving aid 74 to cover a width of the cartridge 16 (not shown) which may include components other than the guard, such as one or more blades.

Figure 5:
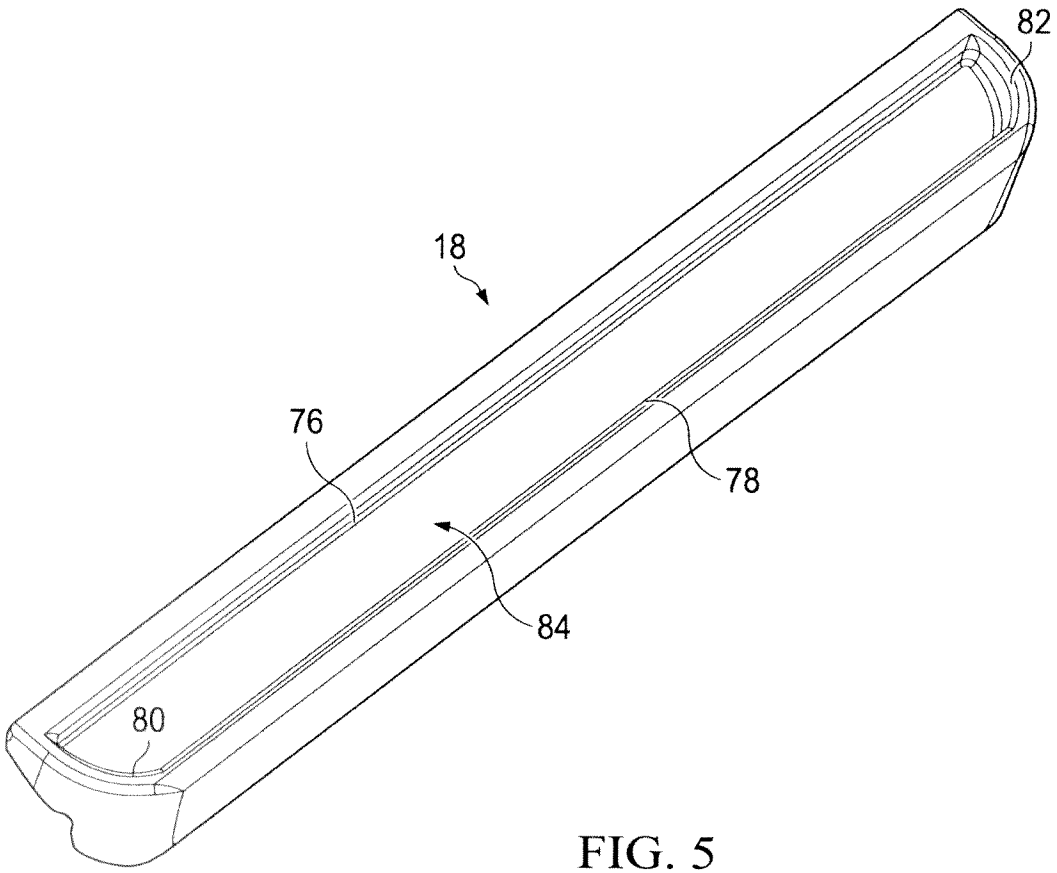
FIG. 5 is a perspective view of one possible embodiment of a guard which may be incorporated in the shaving razor of FIG. 2.

Referring to FIG. 5, a perspective view of the shaving aid retention guard 18 is shown. The shaving aid retention guard 18 may have a front wall 78, a rear wall 76, and a pair of side walls 80 and 82. The front wall 78, the rear wall 76, and the pair of side walls 80 and 82 may define an elongated slot 84 for retaining shaving aid. The front wall 78 and the rear wall 76 may have a length of about 25 mm, 30 mm or 35 mm to about 40 mm, 45 mm or 50 mm. A distance from the front wall 78 to the rear wall 76 may be about 1.5 mm, 2 mm or 2.5 mm to about 3 mm, 3.5 mm or 4 mm. The elongated slot 84 may have a width to length ratio of about 1:5, 1:7 or 1:10 to about 1:15, 1:20 or 1:25. A height of the front wall 78 and the rear wall 76 may each be about 1.0 mm, 1.5 mm or 2.0 mm to about 2.5, 3.0 or 3.5 mm to aid in retaining shaving aid. A short height creates a shallow slot depth which may not be capable of retaining enough shaving aid. In certain embodiments the elongated slot 84 may incline from the front wall 78 to the rear wall 76 such that the height of the front wall 78 is greater than the height of the rear wall 76, which may aid in retaining and applying the shaving aid(s). The shaving aid retention guard 18 may be manufactured from an elastomeric material or may be manufactured from a porous material. In certain embodiments the shaving aid retention guard 18 may be injection molded to the cartridge 16 (not shown) or may be joined with other assembly processes such as adhesives or snap fit designs.

Figure 6:
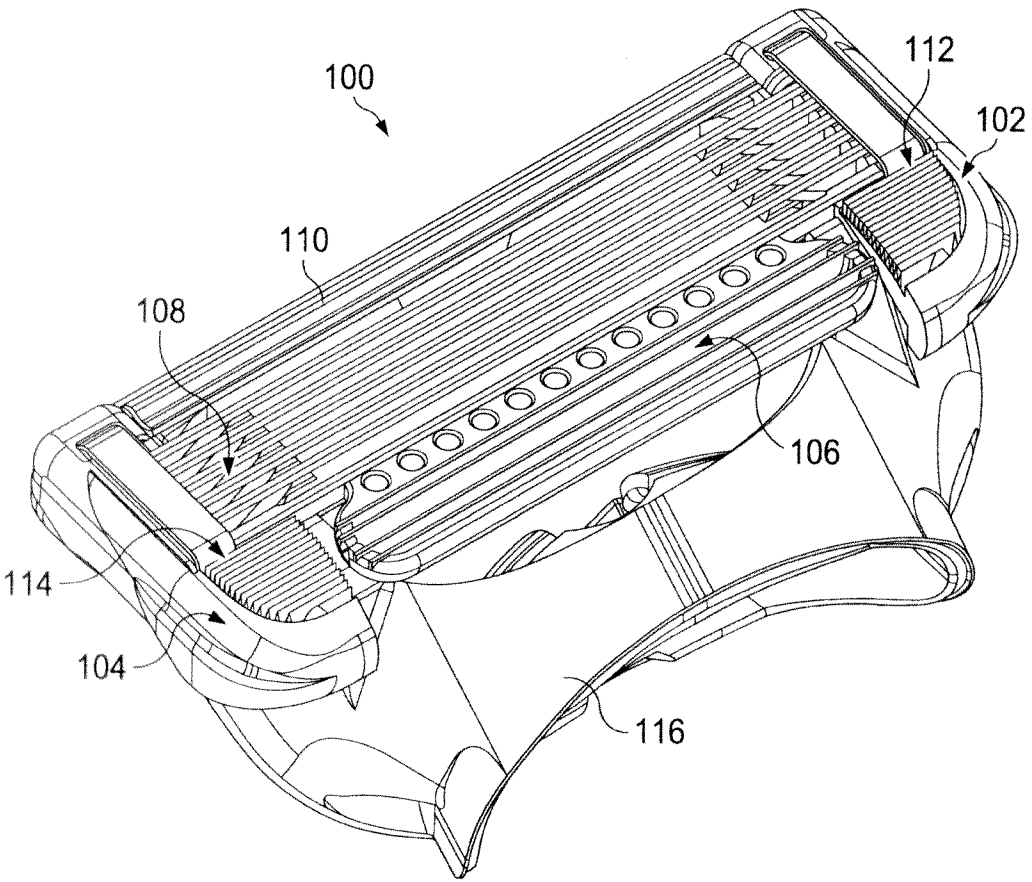
FIG. 6 is a perspective view of one possible embodiment of a shaving razor cartridge.

Referring to FIG. 6 an alternative embodiment of a cartridge 100 is shown which may be used to apply a shaving aid. A front portion of the cartridge 100 may include a pair of primary guards 102 and 104 and a shaving aid retention guard 106 positioned between the pair of primary guards 102 and 104. One or more blades 108 may be mounted to the cartridge 100 between a cap 110 at a back portion of the cartridge 100 and the pair of primary guards 102 and 104 at the front portion of the cartridge 100. The pair of primary guards 102 and 104 may each have a skin stretching member, such as a plurality of fins 112 and 114 that extend parallel to the one or more blades 108. The plurality of fins 112 and 114 may stretch a surface of skin to be shaved to provide a closer shave. The cartridge 100 may be pivotably joined to an interconnect member 116 which may aid in mounting the cartridge 100 to a handle (not shown), similar to the handle 14 and cartridge 16 as previously described. The shaving aid retention guard 106 may also be used in addition to or in place of the cap 110, thus the cartridge 100 may also include a plurality of shaving aid retention guards 106 or the cartridge 100 may have the shaving aid retention guard 106 at the back portion of the cartridge 100.

Figure 7:
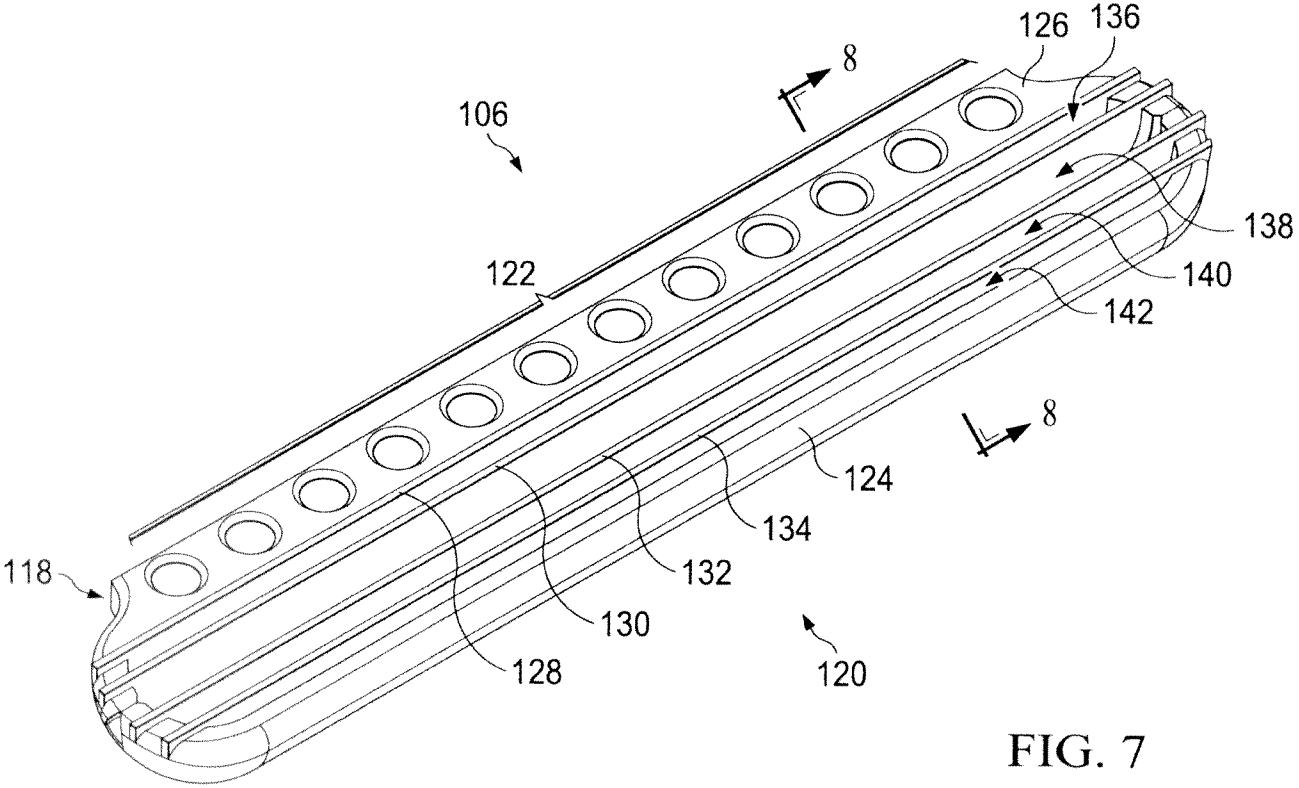
FIG. 7 is a perspective view of one possible embodiment of a guard which may be incorporated in the cartridge of FIG. 6.

Referring to FIG. 7 a perspective view of the shaving aid retention guard 106 is shown. The shaving aid retention guard 106 may have a proximal end portion 118 and a distal end portion 120. The proximal end portion 118 and the distal end portion 120 may each have a length of about 25 mm, 30 mm or 35 mm to about 40 mm, 45 mm or 50 mm. The proximal end portion 118 may define a series of generally circular depressions 122 positioned along a length of the proximal end portion 118 of the shaving aid retention guard 106. The distal end portion 120 may have a front wall 124, a rear wall 126 and a plurality of intermediate walls 128, 130 and 132 which extend generally the length of the distal end portion 120. The plurality of intermediate walls 128, 130, 132 and 134 may define a plurality of elongated slots 136, 138, 140 and 142. A height of the front wall 124, the rear wall 126 and the plurality of intermediate walls 128, 130 and 132 may each be about 1.0 mm, 1.5 mm or 2.0 mm to about 2.5, 3.0 or 3.5 mm to aid in retaining shaving aid. A short height creates a shallow slot depth which not may be capable of retaining enough shaving aid.

Figure 8A:
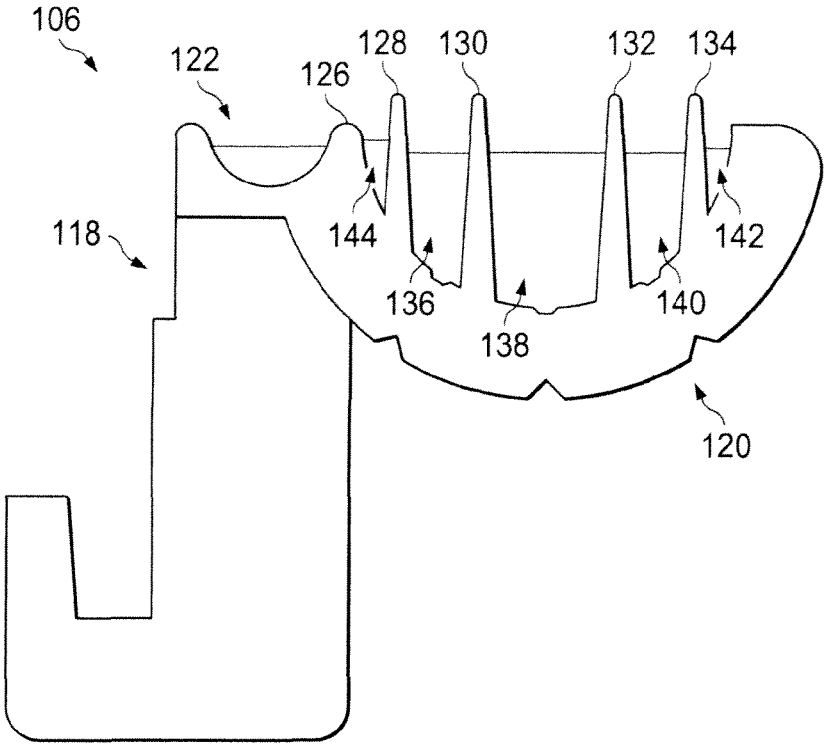
FIG. 8A is a cross section view of the guard of FIG. 7 in a first or neutral position, taken generally along the line 8-8.
Figure 8B:
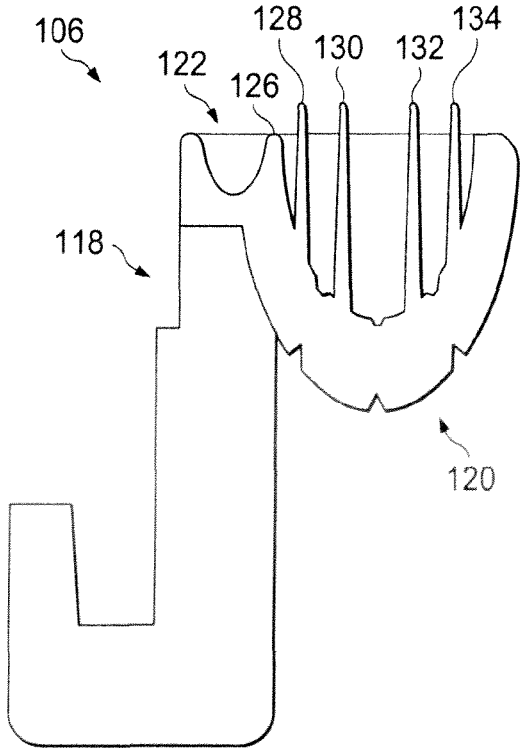
FIG. 8B is a cross section view of the guard of FIG. 7 in a second or compressed position, taken generally along the line 8-8.

Referring to FIGS. 8A and 8B, a cross section view of the shaving aid retention guard 106 is shown, taken generally along the line 8-8 of FIG. 7. The shaving aid retention guard 106 may have a first compressed position (FIG. 8B) and a second or uncompressed position (FIG. 8). The shaving aid retention guard 106 may be in the neutral position as the cartridge 100 is inserted into a container of shaving aid (as shown in FIG. 2) or as shaving aid is applied from the tube 72 of sachet 71 (as shown in FIGS. 4A and 4C). The shaving aid retention guard 106 may be in the compressed position when the cartridge 100 is pressed against the surface of the skin while shaving.

The distal end portion 120 of the shaving aid retention guard 106 may have a generally circular body from which the intermediate walls 128, 130, 132 and 134 extend. Although four intermediate walls 128, 130, 132 and 134 are shown more or less intermediate walls may be used. A distance between adjacent intermediate walls 128, 130, 132 and 134 may be about 0.2 mm, 0.3 mm or 0.55 mm to about 0.7 mm, 0.9 mm or 1.0 mm when the shaving aid retention guard 106 is in the neutral position. The neutral position allows the shaving aid retention guard 106 to take up more shaving aid. The shaving aid may be captured within the generally circular depressions 122 and the plurality of elongated slots 136, 138, 140 and 142. There may also be a slot 144 defined by the rear wall 126 and intermediate wall 136 that captures shaving aid. A distance between adjacent intermediate walls 128, 130, 132 and 134 may also be referred to as slot width. The slot width of the shaving aid retention guard 106 may be greater than the slot width of the pair of primary guards 112 and 114 (FIG. 6), in order to trap or hold more shaving aid. In certain embodiments the gap width of the shaving aid retention guard 106 may be about 1.5, 2 or 3 times to about 4, 5 or 6 times as great as the slot width of the pair of primary guards 112 and 114 (FIG. 6).

The generally circular depressions 122 of the proximal end portion 118 may be directly adjacent the rear wall 126. The circular depressions 122 may also have a neutral position (FIG. 8A) and a compressed position (FIG. 8B). In the neutral position, the generally circular depressions 122 may have a radius of about 0.15 mm, 0.3 mm, or 0.55 mm to about 0.7 mm, 0.9 mm or 1.0 mm. In the compressed position, the generally circular depressions 122 may compress about 25%, 30%, or 40% to about 50%, 75% or even 100%. The shaving aid retention guard 106 may be manufactured from an elastomeric material or may be manufactured from a porous material which facilitates the compression and the release of the shaving aid. The shaving aid retention guard 106 may have a Shore A hardness of about 10, 20 or 30 to about 60, 70 or 80. In certain embodiments the shaving aid retention guard 106 may be injection molded to the cartridge 100 (FIG. 6) or may be joined with other assembly processes such as adhesives or snap fit designs.

The circular depressions 122 and the plurality of slots 136, 138, 140 and 142 may facilitate the retaining of shaving aid as the cartridge 100 (not shown) is inserted into a container of shaving aid 22 (as shown in FIG. 2) or as shaving aid is applied from the tube 72 or sachet 71 (as shown in FIGS. 4A and 4C). The depressions 122 and the intermediate walls 128, 130, 132 and 134 may inhibit the release of the shaving aid as the cartridge 100 (not shown) is place against the surface of the skin to be shaved. A force of the shaving aid retention guard 106 being pressed against the surface of the skin may compress the intermediate walls 128, 130, 132 and 134 closer together and release the shaving aid. In certain embodiments, the intermediate walls 128, 130, 132 and 134 may compress such that they contact each other to force the shaving aid from the elongated slots 136, 138, 140, 142 and 144 and onto the surface of the skin. The generally circular depressions 122 may also compress to release the shaving aid during shaving.

If desired, particular embodiments may be optionally practiced separately or together. For example, the method of shaving may use any of the cartridges with shaving aid retaining guards described above or the shaving system may include any of the cartridges with shaving aid retaining guards mentioned above.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm"

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A shaving system comprising a safety shaving razor having an elongated handle and a cartridge mounted to the elongated handle, the cartridge including a shaving aid retention guard;

a shaving tray having a first portion dimensioned to receive the safety shaving razor during storage and a second portion defining a receptacle; and a container of shaving aid positioned within the receptacle, wherein the shaving aid has a viscosity of about 10 centipoises to about 500 centipoises at about 23 degrees Celsius, wherein the shaving aid retention guard has a front wall and a rear wall each having a height of about 1.0 mm to about 3.5 mm.

2. The shaving system of claim 1 wherein the container of shaving aid is dimensioned to receive the cartridge during shaving.

3. The shaving system of claim 2 wherein the container of shaving aid has a peelable lid.

4. The shaving system of claim 2 wherein the container of shaving aid has a resealable lid.

5. The shaving system of claim 2 wherein the shaving tray has a shaving handle retention member.

6. The shaving system of claim 5 wherein the shaving tray has a recessed portion dimensioned to receive the cartridge of the safety shaving razor during storage.

7. The shaving system of claim 6 wherein the receptacle and the recessed portion are positioned at opposite end portions of the shaving tray.

8. The shaving system of claim 6 further comprising a second receptacle at a second end portion of the tray.

9. The shaving system of claim 1 wherein the container of shaving aid has a width and a length that generally corresponds to a length and width of the cartridge.

10. The shaving system of claim 1 wherein the container of shaving aid has a height of about 10 mm to about 40 mm.

11. The shaving system of claim 1 wherein the shaving aid retention guard has a front wall and a rear wall each having a height of about 2.0 mm to about 3.5 mm.

12. The shaving system of claim 1 wherein the shaving aid retention guard has a front wall, a rear wall, and a pair of side walls that define an elongated slot.

13. The shaving system of claim 12 wherein the front wall and the rear wall each having a height of about 2.0 mm to about 3.5 mm.

* * * * *